US011572700B2

(12) United States Patent
Shaw et al.

(10) Patent No.: US 11,572,700 B2
(45) **Date of Patent: *Feb. 7, 2023**

(54) SYSTEM AND METHOD FOR SHOTCRETE CONSTRUCTION

(71) Applicant: Shaw Craftsmen Concrete, LLC, Costa Mesa, CA (US)

(72) Inventors: Ronald D. Shaw, Costa Mesa, CA (US); Jeff Counterman, Costa Mesa, CA (US)

(73) Assignee: Shaw Craftsmen Concrete, LLC, Costa Mesa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/360,186

(22) Filed: Jun. 28, 2021

(65) Prior Publication Data

US 2021/0324640 A1 Oct. 21, 2021

Related U.S. Application Data

(63) Continuation of application No. 16/736,540, filed on Jan. 7, 2020, now Pat. No. 11,072,932.

(51) Int. Cl.
*E04F 21/05* (2006.01)
*E04G 21/02* (2006.01)

(52) U.S. Cl.
CPC ..... *E04F 21/05* (2013.01); *E04G 21/02* (2013.01)

(58) Field of Classification Search
CPC ..... E04F 21/05; E04G 21/02; E04G 21/0418; E04G 21/10; E04B 2/842
See application file for complete search history.

(56) References Cited

U.S. PATENT DOCUMENTS

| | | | |
|---|---|---|---|
| 1,769,990 | A | 7/1930 | Fischer |
| 1,891,530 | A | 12/1932 | Galassi |
| 1,939,007 | A | 12/1933 | Heltzel |
| 1,958,391 | A | 5/1934 | Hall et al. |

(Continued)

OTHER PUBLICATIONS

PNA Constructions Technologies; "PNA Square Dowel Basket Isometric"; 2 pgs. (Jun. 2004).

(Continued)

*Primary Examiner* — Rodney Mintz
(74) *Attorney, Agent, or Firm* — Stetina Brunda Garred and Brucker

(57) ABSTRACT

Systems and methods of shotcrete construction are contemplated whereby guide rails are placed in proximity and forward to a shotcrete receiving surface, with any guide rails disposed directly in front of the shotcrete receiving surface being configured to be offset from the receiving surface allowing shotcrete to be sprayed behind the offset guide rails. Following application of shotcrete, a screed configured to engage with and traverse along at least two of the guide rails may be used to rod the shotcrete via a protruding region of the screed extending beyond the guide rails, thereby removing excess shotcrete and imparting to the shotcrete surface a contour at least partially defined by the configuration of the guide rails and the configuration of the protruding region of the screed. Complex, precise, and even exotic architectural shotcrete installations may be created in this fashion by providing a suitable set of guide rails and screed.

20 Claims, 8 Drawing Sheets

(56) References Cited

U.S. PATENT DOCUMENTS

| | | | | |
|---|---|---|---|---|
| 1,997,216 | A | 4/1935 | Heltzel | |
| 2,172,629 | A | 9/1939 | Treuhaft | |
| 2,296,453 | A | 9/1942 | Saffert | |
| 2,925,831 | A | 2/1960 | Welty et al. | |
| 2,949,828 | A | 8/1960 | Carnes | |
| 3,157,097 | A | 11/1964 | Stinnett, Jr. et al. | |
| 3,368,464 | A | 2/1968 | Thorp, Jr. et al. | |
| 3,441,457 | A | 4/1969 | Regnaud | |
| 3,590,448 | A | 7/1971 | Bryant | |
| 3,797,867 | A | 3/1974 | Hartl | |
| 3,798,868 | A | 3/1974 | Loranger | |
| 3,816,155 | A | 6/1974 | Iverson et al. | |
| 3,838,930 | A | 10/1974 | Koch | |
| 3,967,911 | A | 7/1976 | Miers | |
| 4,008,974 | A | 2/1977 | Miers | |
| 4,128,358 | A | 12/1978 | Compton | |
| 4,190,997 | A | 3/1980 | Holt | |
| 4,198,176 | A | 4/1980 | Bentz | |
| 4,388,016 | A | 6/1983 | Levey | |
| 4,697,951 | A | 10/1987 | Allen | |
| 4,748,788 | A | 6/1988 | Shaw et al. | |
| 4,769,201 | A | 9/1988 | Chiuminatta et al. | |
| 4,889,455 | A | 12/1989 | Karlsson et al. | |
| 4,915,888 | A | 4/1990 | Sato | |
| 5,010,982 | A | 4/1991 | Sedlmayr | |
| 5,024,029 | A | 6/1991 | Abbott et al. | |
| 5,042,211 | A | 8/1991 | Nestler | |
| 5,092,091 | A | 3/1992 | Hull et al. | |
| 5,125,953 | A | 6/1992 | Gattner et al. | |
| 5,234,128 | A | 8/1993 | Hill | |
| 5,246,650 | A | 9/1993 | Clark | |
| 5,395,673 | A | 3/1995 | Hunt | |
| 5,450,699 | A | 9/1995 | Lee | |
| 5,755,068 | A | 5/1998 | Ormiston | |
| 5,794,401 | A | 8/1998 | Shaw et al. | |
| 5,888,017 | A | 3/1999 | Corrie | |
| 5,910,087 | A | 6/1999 | Carter | |
| 5,956,912 | A | 9/1999 | Carter et al. | |
| 5,975,985 | A | 11/1999 | Sutherland et al. | |
| 6,016,635 | A | 1/2000 | Shaw et al. | |
| 6,033,146 | A | 3/2000 | Shaw et al. | |
| 6,092,960 | A | 7/2000 | Mccallion | |
| 6,171,016 | B1 | 1/2001 | Pauls et al. | |
| 6,238,277 | B1 | 5/2001 | Duncan et al. | |
| 6,279,282 | B1 | 8/2001 | Krionidis | |
| 6,385,940 | B1 | 5/2002 | Maier et al. | |
| 6,430,824 | B1 | 8/2002 | Smith | |
| 6,610,224 | B2 | 8/2003 | Sullivan | |
| 6,739,805 | B2 | 5/2004 | Shotton | |
| 6,780,369 | B1 | 8/2004 | Darrow et al. | |
| 6,866,445 | B2 * | 3/2005 | Semler | E01C 23/01 52/678 |
| 7,051,483 | B2 | 5/2006 | Bamford | |
| 7,322,772 | B2 | 1/2008 | Shaw et al. | |
| 7,334,962 | B1 | 2/2008 | Shaw et al. | |
| 7,470,083 | B2 * | 12/2008 | Black | E04G 21/10 404/96 |
| 7,591,967 | B2 | 9/2009 | Palermo et al. | |
| 7,607,859 | B2 | 10/2009 | Shaw et al. | |
| 7,614,820 | B2 | 11/2009 | Shaw et al. | |
| 7,670,081 | B2 | 3/2010 | Shaw et al. | |
| 7,781,019 | B2 | 8/2010 | Shaw et al. | |
| 8,079,775 | B2 | 12/2011 | Shaw et al. | |
| D662,523 | S | 6/2012 | Goentzel | |
| 8,936,411 | B1 | 1/2015 | Shaw | |
| 8,962,088 | B2 | 2/2015 | Shaw | |
| 9,487,951 | B2 | 11/2016 | Shaw | |
| 9,579,764 | B1 | 2/2017 | Wetherell et al. | |
| 9,580,915 | B2 | 2/2017 | Shaw | |
| 9,695,602 | B2 | 7/2017 | Shaw | |
| 9,790,693 | B2 | 10/2017 | Wilde | |
| 11,072,932 | B1 * | 7/2021 | Shaw | E04F 21/05 |
| 2003/0113164 | A1 * | 6/2003 | Semler | E04F 21/04 404/75 |
| 2003/0140594 | A1 | 7/2003 | Shaw et al. | |
| 2003/0227814 | A1 | 12/2003 | Priesnitz et al. | |
| 2004/0041295 | A1 | 3/2004 | Shaw et al. | |
| 2004/0118025 | A1 | 6/2004 | Shalit | |
| 2004/0234693 | A1 | 11/2004 | Littleton | |
| 2005/0238429 | A1 | 10/2005 | Kipp | |
| 2007/0187873 | A1 | 8/2007 | Bailey | |
| 2007/0256393 | A1 * | 11/2007 | Black | E04G 21/10 52/749.13 |
| 2010/0139196 | A1 | 6/2010 | Healy | |
| 2012/0317912 | A1 | 12/2012 | Shaw | |
| 2013/0125504 | A1 | 5/2013 | Brailsford et al. | |
| 2014/0000214 | A1 | 1/2014 | Vasquez, Jr. et al. | |
| 2014/0245694 | A1 | 9/2014 | Shaw | |
| 2014/0272147 | A1 | 9/2014 | Shaw | |
| 2015/0020475 | A1 | 1/2015 | Shaw | |
| 2016/0047121 | A1 | 2/2016 | Shaw | |
| 2016/0069090 | A1 * | 3/2016 | Shaw | B29C 39/146 264/34 |
| 2017/0101745 | A1 | 4/2017 | Ferstriep | |
| 2017/0275893 | A1 | 9/2017 | Shaw | |
| 2017/0298626 | A1 | 10/2017 | Shaw | |
| 2017/0334032 | A1 | 11/2017 | Yagur et al. | |
| 2019/0308342 | A1 | 10/2019 | Butler | |
| 2021/0207388 | A1 * | 7/2021 | Shaw | E04G 21/02 |

OTHER PUBLICATIONS

Sandell Manufacturing Co., Inc.; "Sandell's Zip Strip & Expansion Joint"; 2 pgs. (Oct. 2007).

Family Handyman, "How to Finish Concrete", Jul. 8, 2013 [http://www.familyhandyman.com/masonry/pouring-concrete/how-to-finish-concrete/view-all/].

* cited by examiner

SYSTEM AND METHOD FOR SHOTCRETE CONSTRUCTION

CROSS-REFERENCE TO RELATED APPLICATIONS

The present application is a continuation of U.S. patent application Ser. No. 16/736,540 filed on Jan. 7, 2020, and issued on Jul. 27, 2021 as U.S. Pat. No. 11,072,932, the entire contents of which are incorporated herein by reference

STATEMENT RE: FEDERALLY SPONSORED RESEARCH/DEVELOPMENT

Not Applicable

BACKGROUND

1. Technical Field

The present disclosure relates generally to the art of concrete construction, and more particularly, to a system and method for facilitating the construction of walls, ceilings and other surfaces from concrete.

2. Related Art

In the art of concrete construction, it is commonplace to form concrete walls, ceilings, and other concrete surfaces using shotcrete, also known as sprayed concrete or gunite. Shotcrete, which can refer to both the material and the construction technique itself, involves pneumatically projecting concrete or mortal at high velocity onto a surface, typically a surface that has been prepared in advanced by the placement of reinforcing material such as steel rods, steel mesh, or fibers, such that the sprayed shotcrete will encase the reinforcing material. Shotcrete has many advantages over other methods of concrete construction and offers many benefits in terms of speed, cost, and ease of installation in relation to conventional poured concrete techniques.

However, conventional methods of shotcrete construction suffer from several deficiencies, especially in relation to architectural projects requiring more complex designs or fine attention to aesthetics and detail. Unlike poured concrete where more complex shapes and designs can be achieved via the fabrication of molds, shotcrete is significantly less precise. As such, the primary applications of shotcrete have been in relation to industrial uses of concrete where aesthetics are of less importance, such as in the stabilization of excavation walls or cliffsides, or the lining of swimming pools prior to the placement of tile.

A major deficiency of shotcrete is that it is very difficult for even a skilled artisan to produce a shotcrete wall having different thicknesses at different points on the wall in order to produce a wall or other surface having arcuate, curvilinear, or other exotic characteristics across various dimensions. Previously, in order to accomplish this, protruding dowels, rods, or pins would be placed at various locations protruding from the shotcrete receiving surface to predetermined distances, optionally with wires tied therebetween, and the shotcrete installer would use the length of the rods and/or the wires tied therebetween as a gauge to produce a shotcrete wall having the desired depth at the desired locations. Following this, the shotcrete installer would adjust the wall using a hand tool in their best attempt to blend the areas of differing depths to produce the desired arcuate, curvilinear, or other exotic surface. This technique is extremely imprecise and labor intensive, and frequently fails to meet the aesthetic needs of the project. Further, to produce designs with more extreme arcuate, curvilinear, or other exotic characteristics may require an unwieldy amount of guide rods to be placed and may require such extreme labor and attention to detail, both before, during, and after the shotcrete spraying, that the advantages of shotcrete construction over poured concrete construction entirely disappear.

As such, it may be seen that novel shotcrete construction techniques which may remedy these and other deficiencies associated with the prior art are desirable.

BRIEF SUMMARY

To solve these and other problems, systems and methods of shotcrete construction are contemplated whereby, in an exemplary embodiment, guide rails are placed in proximity and forward to a shotcrete receiving surface, with the guide rails disposed directly in front of the shotcrete receiving surface being configured to be offset therefrom such that shotcrete may be sprayed against the receiving surface behind the offset guide rails to form an uninterrupted shotcrete surface. Following application of shotcrete to the receiving surface, a screed configured to engage with and traverse along at least two of the guide rails may be used to rod the shotcrete via a protruding region of the screed extending beyond the guide rails, thereby removing excess shotcrete and imparting to the shotcrete a contour at least partially defined by the configuration of the guide rails. Likewise, the protruding region itself of the screed may also be varied to further define the contour of the shotcrete. It may thus be seen that complex, precise, and even exotic architectural shotcrete installations may be created in this fashion by providing a suitable set of guide rails and screed, representing in a substantial increase in precision and speed over conventional architectural shotcrete techniques.

According to one embodiment of the present disclosure, a system for shotcrete construction is contemplated, the system comprising a plurality of guide rails configured for placement proximal to a shotcrete receiving surface and in substantially parallel alignment to one another, at least one of the guide rails having a spaced region configured to be forwardly offset from the shotcrete receiving surface such that when the spaced region of the guide rail is placed in front of the shotcrete receiving surface, shotcrete may be applied against the portion of the shotcrete receiving surface behind the spaced region, and a screed configured for simultaneous engagement with and traversal along at least a portion of at least two of the guide rails, the screed having a protruding region such that when the screed is engaged with and traversed along at least a portion of at least two chosen guide rails following application of shotcrete against the shotcrete receiving surface, the protruding region is operative to rod the shotcrete so as to impart a contour to the shotcrete at least partially defined by the configuration of the at least two chosen guide rails.

At least two guide rails may be configured for substantially vertical alignment proximal to a shotcrete receiving surface, with the screed configured for substantially horizontal simultaneous engagement with at least two guide rails. Each of the plurality of guide rails may be substantially identical configured such that the contour imparted to the shotcrete is substantially similar along the direction of the shotcrete surface substantially perpendicular to the substantially parallel direction of the guide rails. Alternatively, at least two of the plurality of guide rails may be substantially differently configured such that the contour imparted to the shotcrete is substantially dissimilar along the direction of the shotcrete surface substantially perpendicular to the substantially parallel direction of the guide rails.

More particular embodiments having at least three guide rails are also contemplated, with each of the least three guide rails being configured for placement at a regular predefined interval from one or more adjacent guide rails. In such embodiments, the screed may be configured to permit simultaneous engagement with and traversal along any adjacent pair of the at least three guide rails.

The screed may be configured to engage with and traverse along at least one guide rail via sliding frictional engagement. The screed may also be configured to engage with and traverse along at least one guide rail via coupling engagement. The protruding region of the screed operative to rod the shotcrete may also be configured to be one or more of: linear, arcuate, curvilinear, serrated, smooth, or combinations thereof.

According to another exemplary embodiment of the present disclosure, a method for shotcrete construction is contemplated, the method comprising at least the steps of (1) providing a plurality of guide rails in proximity to a shotcrete receiving surface in substantially parallel alignment to one another and a screed configured for simultaneous engagement with and traversal along at least a portion of at least two of the guide rails, at least one of the guide rails having a spaced region configured to be forwardly offset from the shotcrete receiving surface such that when the spaced region of the guide rail is placed in front of the shotcrete receiving surface, shotcrete may be applied against the portion of the shotcrete receiving surface behind the spaced region, the screed having a protruding region, (2) applying shotcrete to the shotcrete receiving surface; and (3) simultaneously engaging the screed with and traversing the screed along at least a portion of at least chosen two guide rails to cause the protruding region to rod the shotcrete and impart a contour thereto at least partially defined by the configuration of the at least two chosen guide rails.

BRIEF DESCRIPTION OF THE DRAWINGS

These and other features and advantages of the various embodiments disclosed herein are better understood with respect to the following descriptions and drawings, in which.

Common reference numerals are used throughout the drawings and the detailed description to indicate the same elements.

DETAILED DESCRIPTION

According to various aspects of the present disclosure, systems and methods of shotcrete construction are contemplated, wherein according to an exemplary embodiment, guide rails are placed in proximity and forward to a shotcrete receiving surface, with the guide rails disposed directly in front of the shotcrete receiving surface being configured to be offset therefrom such that shotcrete may be sprayed against the receiving surface behind the offset guide rails to form an uninterrupted shotcrete surface. Following application of shotcrete to the receiving surface, a screed configured to engage with and traverse along at least two of the guide rails may be used to rod the shotcrete via a protruding region of the screed extending beyond the guide rails, both removing excess shotcrete and furthermore imparting to the shotcrete a contour at least partially defined by the configuration of the guide rails and which may be at least partially defined by the configuration of the screed.

Figure 1:
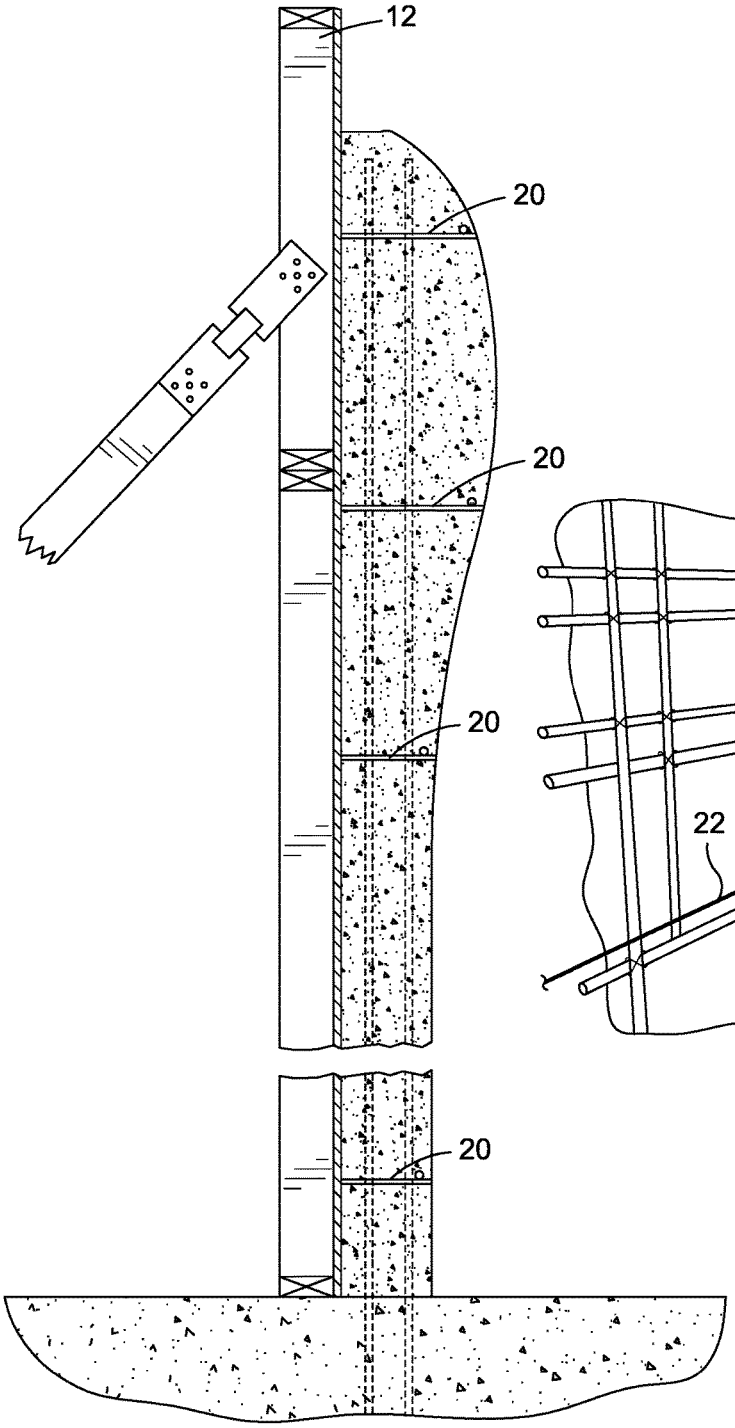
FIG. 1 (Prior Art)
FIG. 1 is a side view illustrating shotcrete wall formed via conventional prior art methods.

Turning now to FIG. 1, a prior art method of shotcrete construction is illustrated whereby pencil rods 20 are located at the shotcrete receiving surface, alone or in combination with guide wires 22, with such pencil rods and/or guide wires being used to visually judge the correct depth of shotcrete to be applied to the shotcrete receiving surface 12 and the intended contour to impart to the shotcrete surface, with such pencil rods 20 ultimately being embedded within the shotcrete. In view of the herein described system and method, the deficiencies of this conventional system become clear, as not only is this conventional system substantially less precise than the herein described system and method due to generally relying on human optical judgment alone, but it may also be seen that production of more complex contours in concrete surface rapidly becomes more and more labor and material intensive, and may require an extremely unwieldly amount of pencil rods 20 to be utilized, which may require such a substantial amount of time and labor such that the advantages of shotcrete techniques over poured techniques become entirely offset. Furthermore, such prior art techniques rely, during the rodding step, on the capability of the individual using the screed to blend together the regions between the pencil rods 20 to achieve a desired contour. Such human ability to produce adequate blending is notoriously difficult and unreliable, and generally requires a great amount of skill and effort, often resulting in the fabrication of a wall having a imperfect contour which in many cases will not meet the needs of a more demanding architect, especially when the shotcrete is designed to at least partially fulfill aesthetic purposes and not merely for structural purposes alone where aesthetics are substantially less important.

Figure 2:
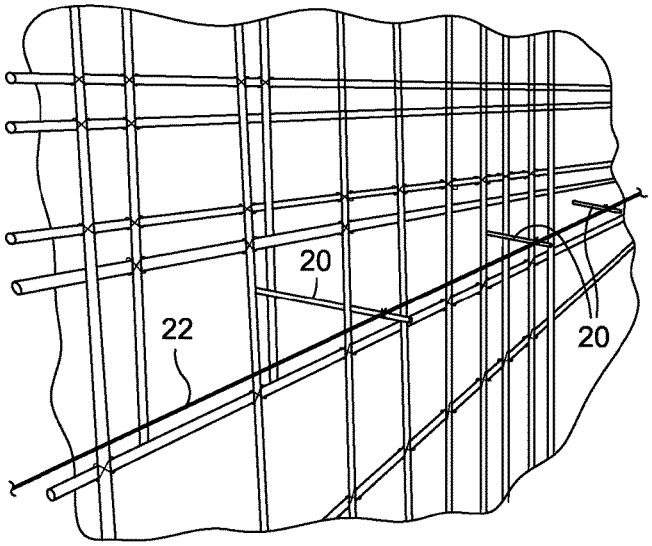
FIG. 2 (Prior Art)
FIG. 2 is a perspective view illustrating a conventional prior art system for shotcrete wall construction.

Turning now to FIG. 2, the above described prior art system of pencil rods 20 and guide wires 22 may more fully be seen prior to the application of shotcrete.

Figure 3:
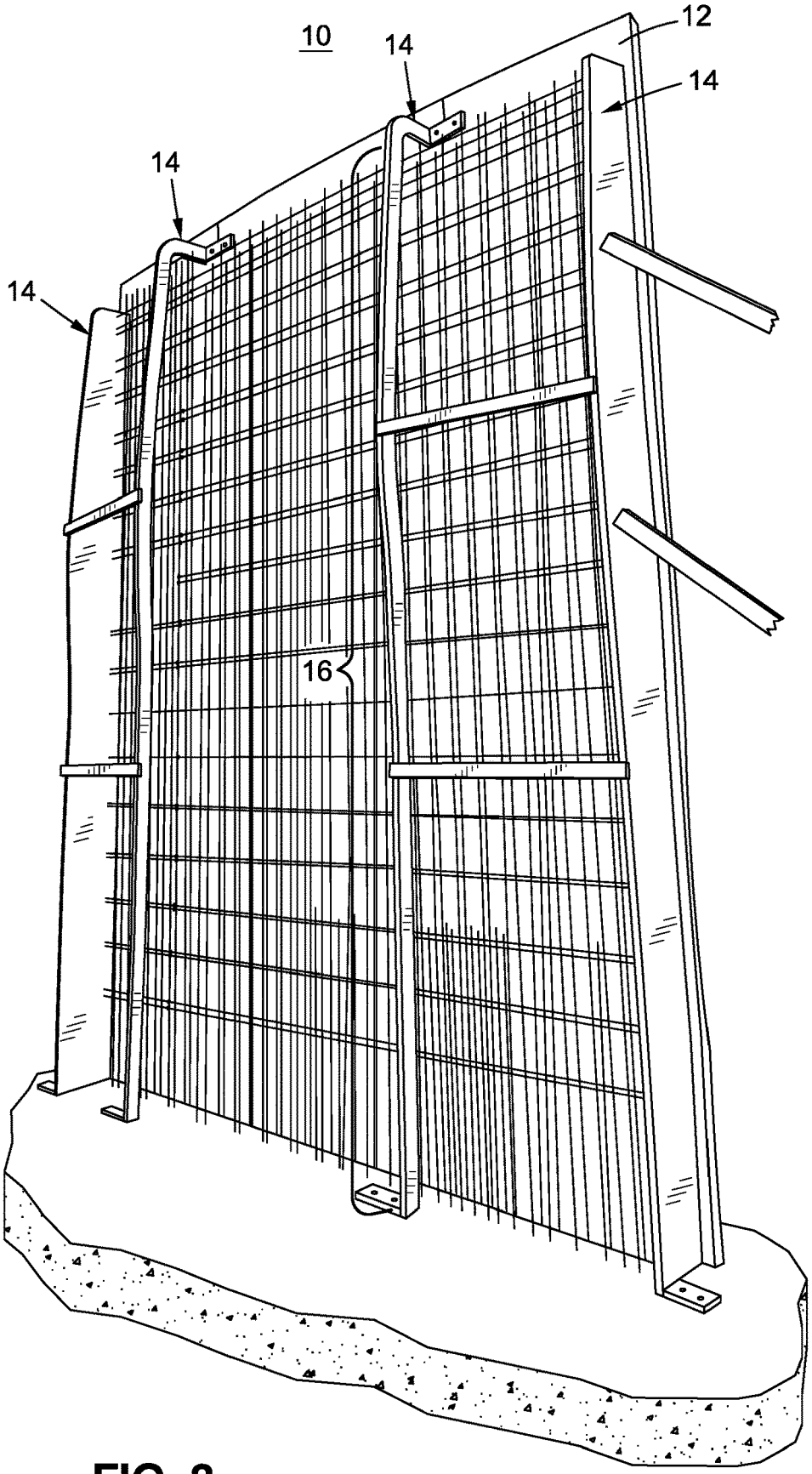
FIG. 3 is perspective view of an exemplary embodiment of a system for shotcrete construction placed proximal to a shotcrete receiving surface.

Turning now to FIG. 3, an exemplary embodiment of a portion of a system for shotcrete construction 10 placed proximal to a shotcrete receiving surface 12 is illustrated. The system for shotcrete construction 10 may be seen to comprise a plurality of guide rails 14 placed proximally the shotcrete receiving surface 12, with the guide rails 14 being generally aligned in a substantially parallel direction, which may be seen to be along the vertical axis in the illustrated exemplary embodiment. However, it may be seen that in other embodiments, the plurality of guide rails 14 may be generally parallel aligned in a different direction, such as horizontally or in any other direction as suitable for the needs of the constructor. It may also be seen that in certain embodiments, there may be multiple pluralities of guide rails 14, with each distinct plurality of guide rails 14 being aligned to be generally parallel in different directions, which may facilitate construction of more exotic contours of shotcrete walls.

At least one of the guide rails 14 may have spaced region 16 configured to be forwardly offset from the shotcrete receiving surface 12 such that when the spaced region 16 of the guide rail 14 is placed in front of the shotcrete receiving surface 12, shotcrete may be deposited against the portion of the shotcrete receiving surface 12 beyond the spaced region. In this way, it may be seen that even when the guide rails 14 are emplaced prior to the spraying of shotcrete, such placement would not interfere with the ability of the applicator to apply a continuous shotcrete surface to the shotcrete receiving surface 12. In some embodiments, the spaced region 16 may be the majority of or substantially all of at least one of the guide rail 14. However, in other embodiments, it may be seen that the spaced region may form only a portion of a guide rail 14. It may also be seen that others of the guide rails 14 may not be configured with a spaced region. For example, it may be seen that according to certain embodiments such as the embodiment illustrated in FIG. 3, the guide rails 14 located at the periphery of the shotcrete receiving surface may also serve as a lateral containing surface for containing the lateral installation of shotcrete at the periphery of the shotcrete receiving surface 12, and as such it may not be desirable for such guide rails 14 to be configured with a spaced region 16, but rather for such guide rails 14 to be in contact with the shotcrete receiving surface 12 or otherwise occlusive of the continuous lateral application of shotcrete.

The guide rails 14 may be constructed from any material known to be useful or usable in the construction or concrete industries for formwork or scaffolding, including but not limited to timber, plywood, metal, plastic, fiberglass, precast concrete, or any other material suitable to or which may be adapted to the herein purposes, or any combination of such materials. In the exemplary embodiment, the guide rails 14 are simple protruding members which extend forwardly from the shotcrete receiving surface 12 at a distance configured to be further than the intended depth of the shotcrete application. Such forward extension distance may be constant along the length of the guide rail 14, or more commonly, may vary along the length of the guide rail 14. Generally, it will be an objective of certain embodiments described herein that the forward extension difference in each area of the guide rail 14 will be more distant that the intended depth of shotcrete application of at the local region of the shotcrete receiving surface 12 proximal to that area of the guide rail 14, such that in the case of guide rails 14 configured with a spaced region 16, the spaced region 16 of the guide rail 14 does not occlude the creation of a continuous surface of shotcrete at the region of the shotcrete receiving surface 12 behind the spaced region 16 such that the spaced region 16 does not become contained within the applied shotcrete. In the case of certain peripheral guide rails 14 which do not contain a spaced region 16 but instead may be used to contain the lateral application of shotcrete, it may still be desirable for the forward extension of the guide rail 14 from the shotcrete receiving surface to be further than the intended depth of the shotcrete proximal thereto, so that the guide rail 14 may still function to laterally contain the shotcrete.

Figure 4:
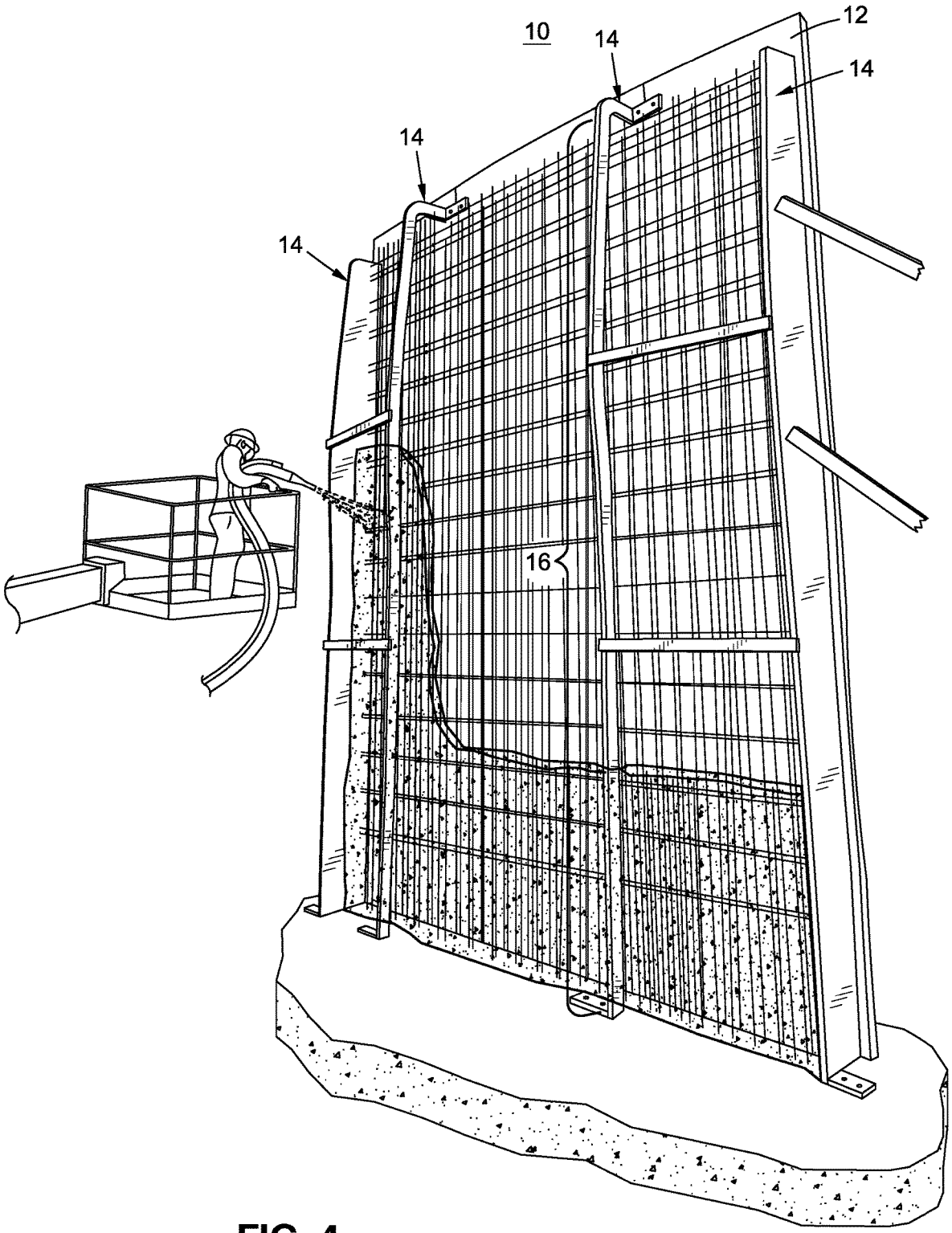
FIG. 4 is a perspective view showing shotcrete being applied to the shotcrete receiving surface illustrated in FIG. 3.

Turning now to FIG. 4, an exemplary embodiment of a step of applying shotcrete to the shotcrete receiving surface 12 is shown. It is to be understood that such step of applying shotcrete may be any method of shotcrete application known or future developed and furthermore, is not necessarily to be limited to the application of concrete or mortar via a pneumatic method or even limited to any method of projecting concrete or mortar, but that the presently contemplated methods, and indeed, the term "shotcrete" as recited here, when referring to a construction technique, is to be understood as encompassing any and all known or future enveloped methods of applying concrete or mortar to a surface or area, including hand application or pouring, and when referring to the physical material used in any such construction technique, may encompass all concretes or mortars or any other material utilized in such construction technique, even if such construction technique does not involve pneumatic or other projection methods. It may even be seen that the presently described or contemplated systems and methods may not necessarily be limited to vertical, upright, or ceiling-like surfaces where shotcrete is typically utilized, but that the presently described or contemplated systems and methods may also be utilized in conventional horizontal poured concrete installation where the guide rails 14 may be, for example, horizontally aligned atop the shotcrete receiving surface 12 of the horizontal poured concrete installation.

As may be seen in FIG. 4, the freshly applied shotcrete may not have a substantially uniform surface or distribution against the shotcrete receiving surface 12, but rather it is highly typical for freshly applied shotcrete to vary in depth to form an irregular fresh shotcrete surface. As such, in order to produce a more regular or otherwise contoured shotcrete surface, the freshly applied shotcrete must be rodded or otherwise manipulated so as to contour the surface of the freshly applied shotcrete in order for the freshly applied shotcrete to cure or dry in the appropriately desired configuration with the desired contour.

Figure 5:
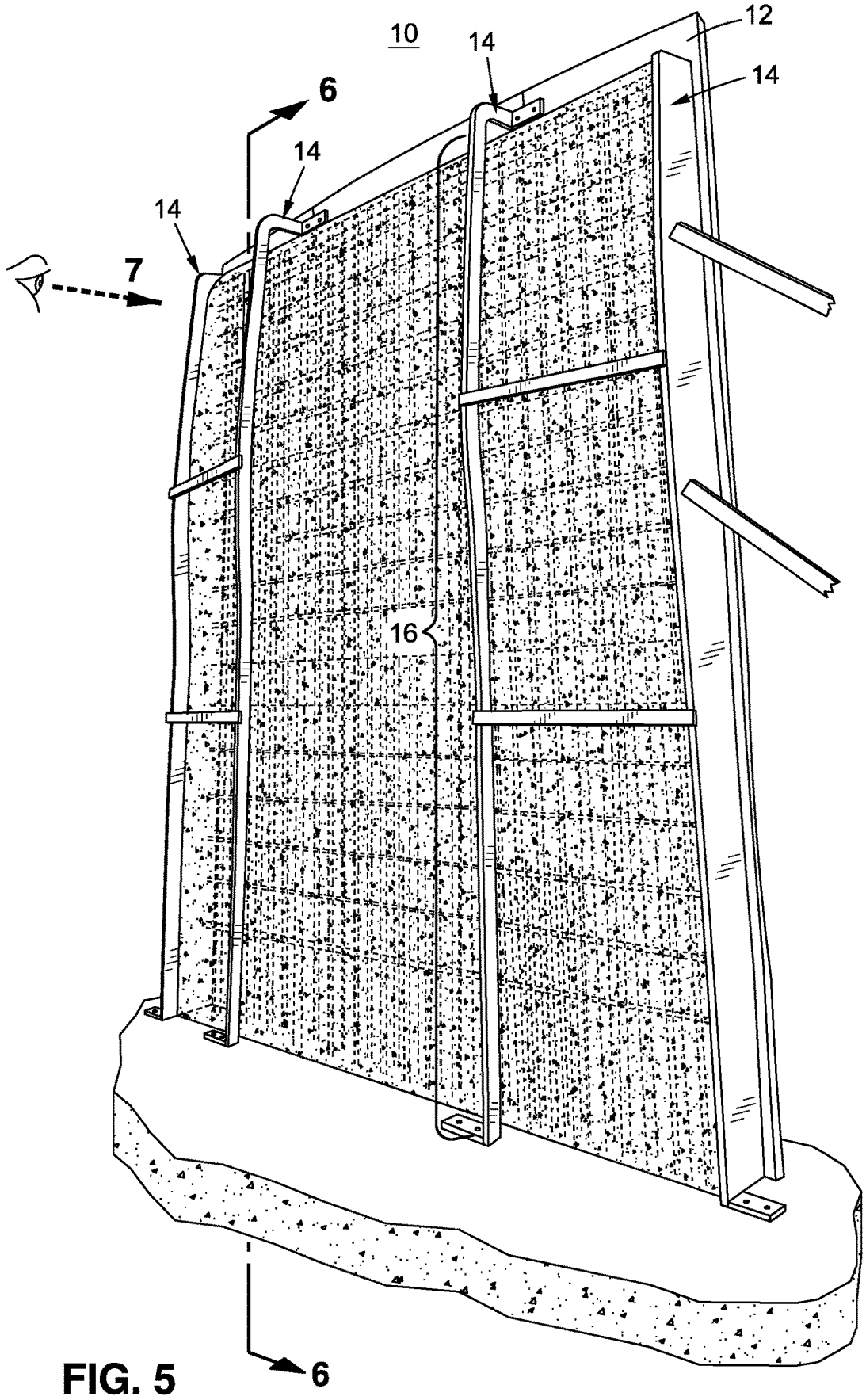
FIG. 5 is a perspective view showing a shotcrete wall formed from the practice of an exemplary method for shotcrete construction using the system of shotcrete construction illustrated in FIG. 3.

Turning now to FIG. 5, an example of a shotcrete wall is illustrated which has been rodded according to an exemplary embodiment of the presently contemplated methods using an exemplary embodiment of a presently contemplated system for shotcrete construction 10 is illustrated, prior to the removal of the system for shotcrete construction 10 and/or the shotcrete receiving surface 12. As may be seen, the contour of the resulting shotcrete wall may depend substantially on the configuration of the guide rails 14.

Figure 6:
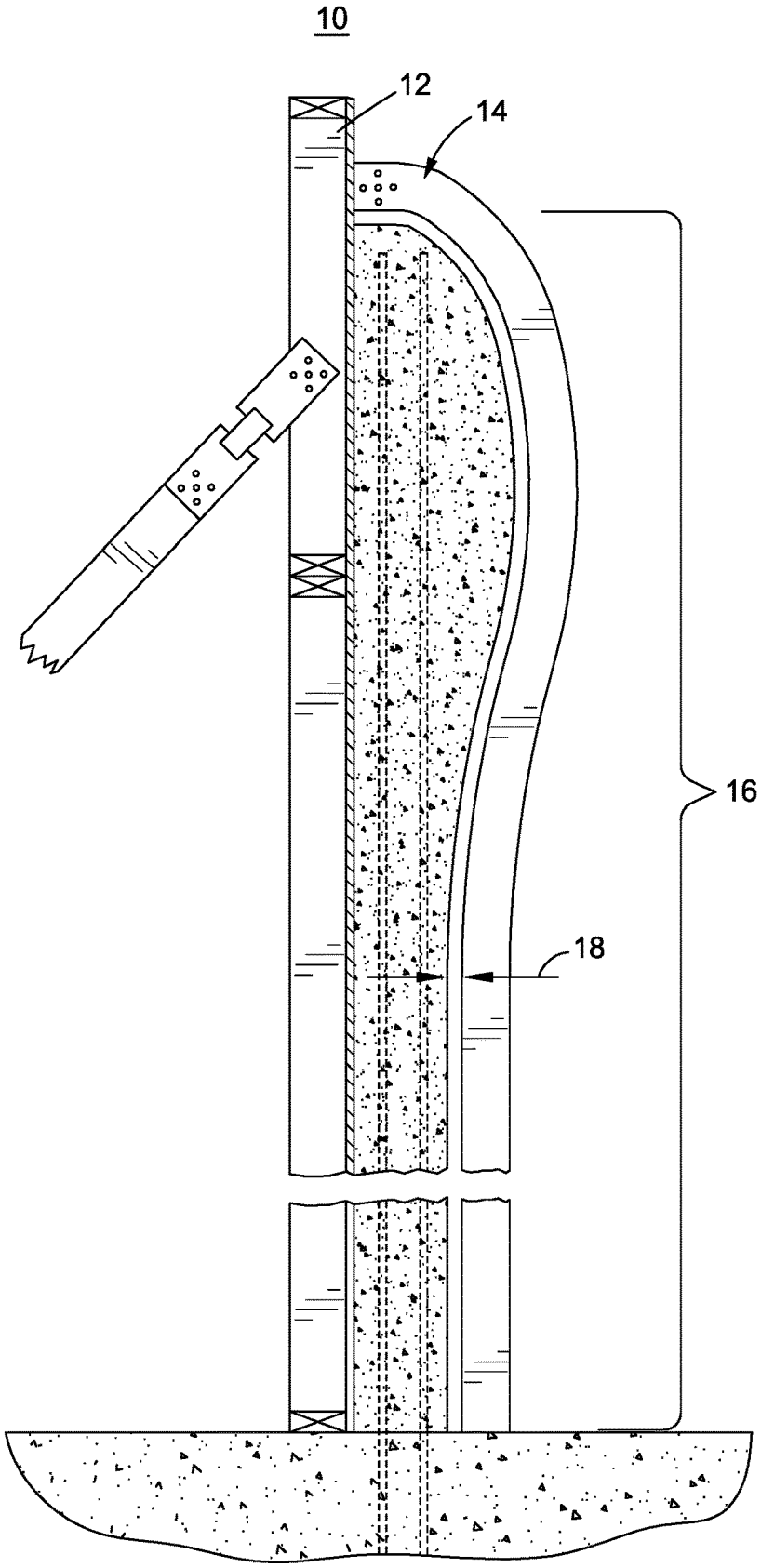
FIG. 6 is a side view of the shotcrete wall shown in FIG. 5.

Turning now to FIG. 6, a side view of a shotcrete wall is illustrated which has been rodded according to an exemplary embodiment of the presently contemplated methods using an exemplary embodiment of a presently contemplated system for shotcrete construction 10 is illustrated, prior to the removal of the system for shotcrete construction 10 and/or the shotcrete receiving surface 12. As may be more fully seen by this figure, the contour of the resulting shotcrete wall may depend substantially on the configuration of the guide rails 14. In particular, it may be seen that via the use of a screed to rod the shotcrete via simultaneous engagement with and traversal along at least a portion of at least two of the guide rails 14, the shotcrete may be contoured so as to result a substantially precise screeding distance 18 between the guide rails 14 and the surface of the resulted contoured shotcrete at all locations. In this way, it may thus be seen that complex contours may be imparted to the shotcrete merely by fabricating guide rails 14 which are adapted to produce such desired complex contours and by ensuring that during the step of rodding the concrete, the screed is maintained in continuous engagement with the guide rails 14 during the traversal thereof. Such complex contours may be, for example but without limitation, arcuate, curvilinear, jagged, or even highly exotic forms. To produce, as in the illustrated embodiment, a shotcrete wall having a contour with a substantially similar cross-sectional thickness across any horizontal portion of the wall, with variation in cross-sectional thickness only across a single dimensional axis of the wall, it may be seen that similarly or identically contoured guide rails 14 may be utilized across the shotcrete receiving surface. However, it may also be seen that to produce even more complex contours, such that those which may vary in cross-sectional thickness across multiple dimensional axis of the shotcrete surface, it may be desirable to utilize differently contoured guide rails 14. Further, it may be seen that multiple separate assemblies of guide rails 14 may be placed and/or utilized simultaneously or in sequence to rod the shotcrete to produce a desired contour of the shotcrete.

Figure 7:
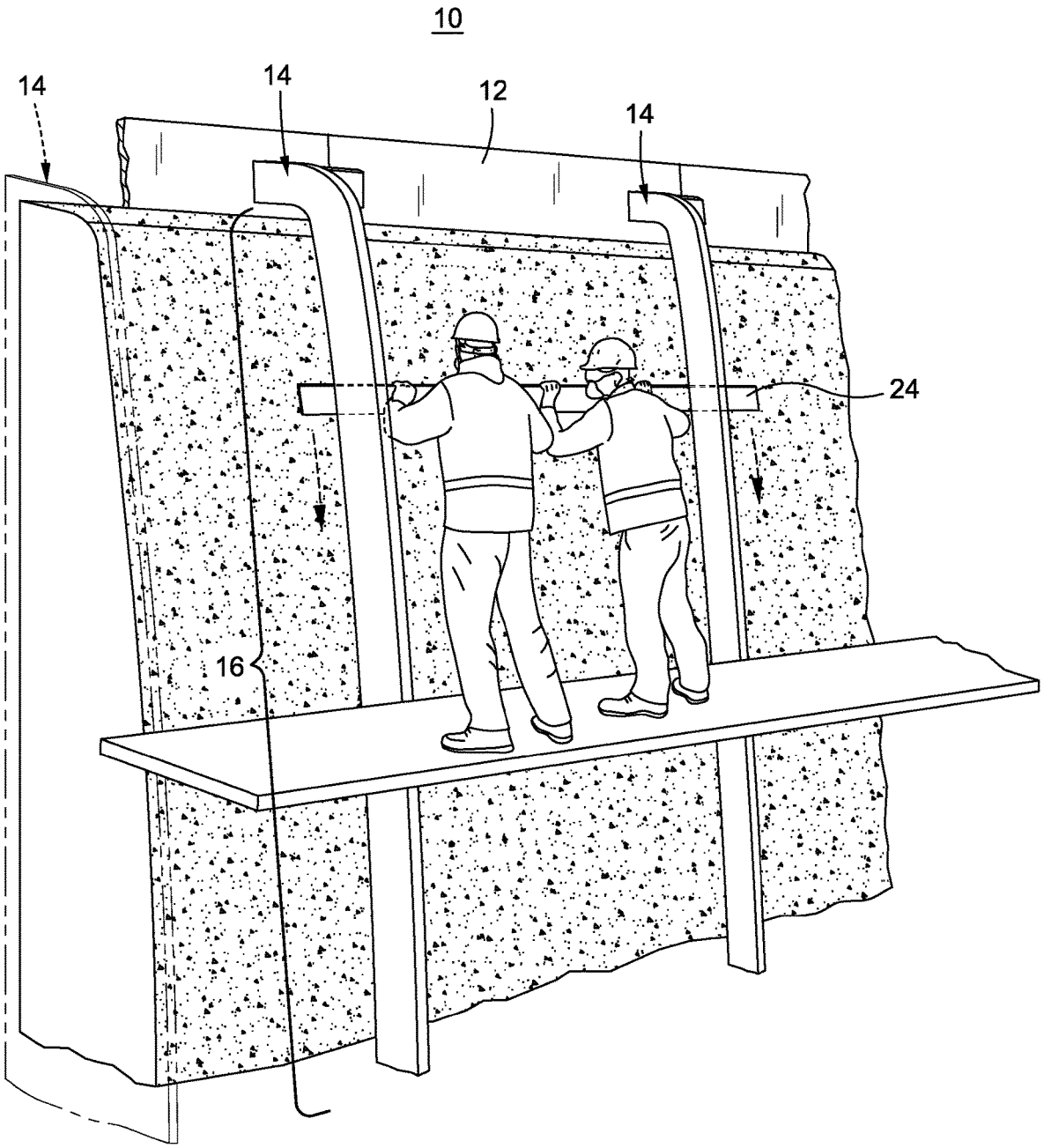
FIG. 7 is a perspective view illustrating, in an exemplary embodiment of a method for shotcrete construction, the step of engaging and traversing the screed along the guide rails to remove excess shotcrete and to impart a contour to the shotcrete surface.

Turning now to FIG. 7, an exemplary embodiment of a step of simultaneously engaging the screed with and traversing a screed 24 along at least a portion of at least chosen two guide rails 14 to cause a protruding region of the screed 24 to rod the shotcrete and impart a contour thereto at least partially defined by the configuration of the at least two chosen guide rails 14 is illustrated. As seen by this illustrated exemplary embodiment, it may be seen that engaging and traversing the screed 24 may comprise physically contacting the screed 24 with the forward surfaces of guide rails 14 and maintaining such engagement while traversing the screed 24 along the guide rails 14 via sliding frictional engagement, and that the system for shotcrete construction 10 may be configured to accomplish this step. However, it may also be seen that in other embodiments of the herein contemplated systems and methods, other ways of the screed 24 engaging with and traversing along the guide rails 14 may be utilized. For example, it may be seen that one or more guide rails 14 may be configured to accept or be accepted by a corresponding feature on the screed 24 so as to result in a coupling between the screed 24 and the guide rails 14. In this way, it may be seen that the requirement to manually apply pressure to the screed to maintain contact against the guide rails 14 may be reduced or eliminated. Examples of such couplings may be, for example and without limitation, features such as bearing surfaces, wheeled or tracked engagements, dovetails, notches, grooves, or any other known or future developed forms of coupling engagement. Versions of screeds 24 are also contemplated wherein manual manipulation of the screed may not even be necessary, for example, in embodiments where the screed may be actuated and traversed along the guide rails 14 via a motor or other form of powered mechanical motion. It may even be seen that, according to more advanced versions of herein contemplated systems, the screed 24 may not necessary be a distinct part from the guide rails 14, but may be integrated therewith, and when not in use, may be positioned at a location on the guide rails 14 which does not interfere with the application of the shotcrete.

It may also be seen that it may be desirable in certain instances that, when three or more guide rails 14 are utilized, for the lateral distance between each respective laterally adjacent guide rail 14 to be substantially identical. This may permit the use of a single screed to rod the shotcrete, rather than requiring use of multiple separately configured screeds for each respective pair of guide rails 14. It may also be seen, however, that other configurations of lateral spacing between guide rails 14 may be utilized, and that corresponding screeds 24 may be utilized to adapt to the lateral spacing of the guide rails 14. It is also envisioned that a single screed 24 may be configured so as to be utilized with different or multiple configurations of lateral spacing between guide rails 14, for example, by including a feature on the screed that permits adjustment of an engagement point on the screed or by including multiple optional engagement points. For example, it is contemplated that the screed 24 may be configured to be telescoping so as to permit adjustment of the distance between two engagement points thereupon so that the screed 24 may be utilized with many possible configurations of lateral distances between guide rails 24.

Figure 8:
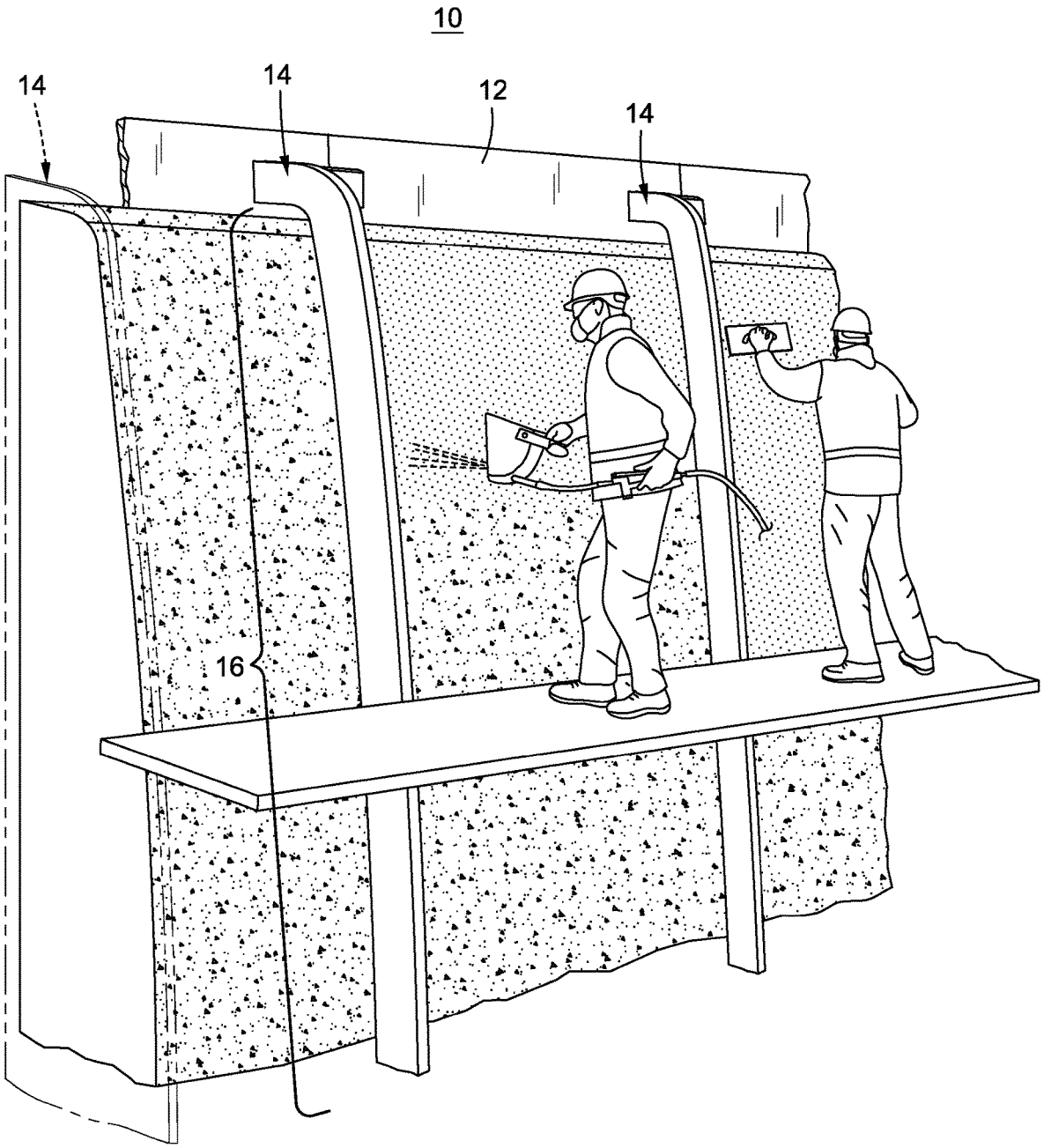
FIG. 8 is a perspective view illustrating the application of a coating to a completed shotcrete wall.

Turning now to FIG. 8, it may be desirable, following the step of rodding the shotcrete, to apply a coating or covering to the shotcrete surface, through any known technique for applying coatings or coverings to shotcrete surfaces, such as spraying or manual application. Such coatings may be, for example but without limitations, aesthetic or protective coatings, or combinations thereof, or coatings to impart other desired characteristics. It may also be seen that besides coatings, other manipulations to the shotcrete surface may be made after the desired contour is achieved via rodding the shotcrete with the screed 24, such as embedding of particulate materials, the installation of tile, a physical manipulation of the shotcrete surface via an abrasive, mechanical or chemical method of altering the shotcrete surface, or any other known or future developed manipulation of the shotcrete surface, all of which are at least equally achievable in a shotcrete surface produced via the herein contemplated methods as compared to known conventional methods, if not more achievable.

Figure 9:
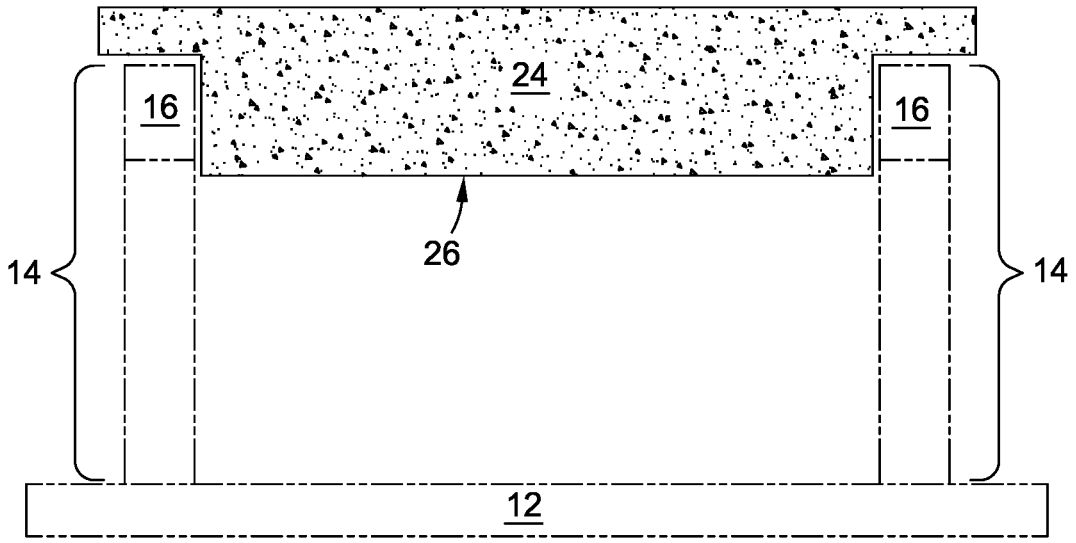
FIG. 9 is a top view illustrating an exemplary embodiment of a screed having a linear protruding surface and being configured for sliding frictional engagement with an adjacent pair of guide rails.

Turning now to FIG. 9, a screed 24 according to an exemplary embodiment of the present disclosure is more fully illustrated, including the protruding region 26 of the screed. It may be seen that the protruding region 26 of the screed 24 may be configured to protrude beyond the spaced region 16 of one or more corresponding guide rails 14 to rod the shotcrete when engaged with two or more of the corresponding guide rails 14 and traversed along the length of the shotcrete, in order to produce a contoured shotcrete at least partially defined by the configuration of the guide rails. In the illustrated embodiment of the screed 24, it may be seen that the protruding region 26 is substantially linear, which may be seen to generally result in the production of a contoured shotcrete which is substantially linearly contoured transverse to the direction across which the screed is traversed. However, it may be seen that in other embodiments, the protruding region 26 of the screed 24 may be configured in other ways, such as arcuate, curvilinear, jagged, stepped, or any other configuration which may at least partially contribute to the production of a contoured shotcrete. Further, embodiments of a screed are also contemplated in which the protruding region may extend laterally behind a spaced region 16 of a guide rail 14 in order to rod shotcrete applied to the shotcrete receiving surface 12 in the region behind a spaced region.

Figure 10:
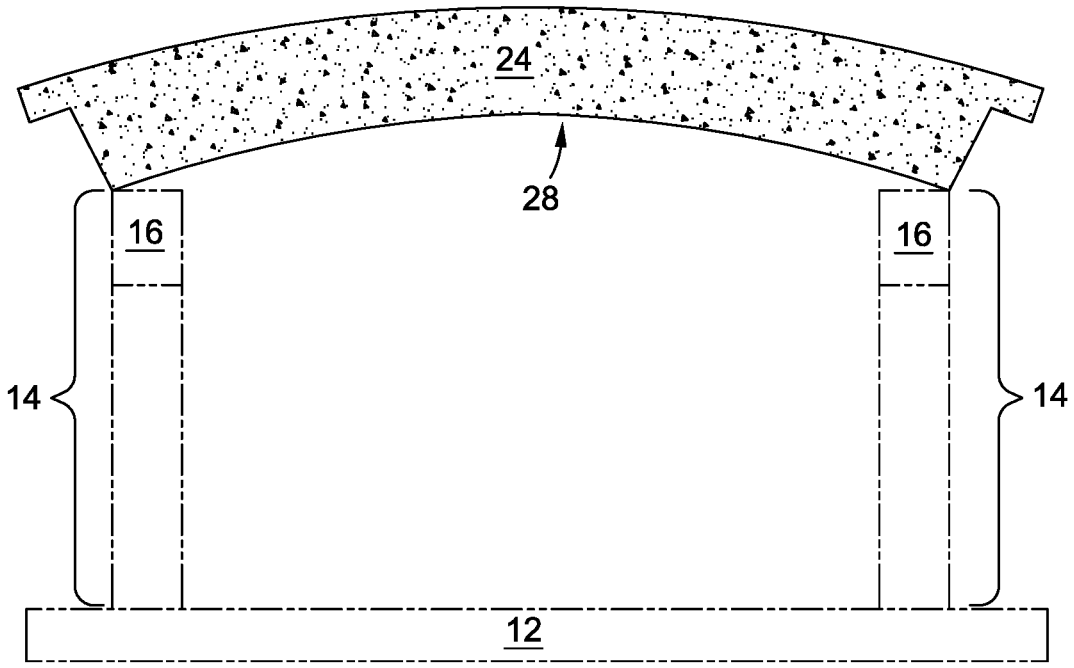
FIG. 10 is a top view of an exemplary embodiment of a screed having an arcuate protruding surface and being configured for sliding frictional engagement.

Turning now to FIG. 10, another embodiment of a screed 24 is illustrated, wherein the protruding region 26 is configured to be arcuate so to at least partially define an arcuate contour in the shotcrete, which may be useful especially for creating arcuate walls or surfaces It may be seen that according to the particular embodiment illustrated, the engagement points on the screed may not be configured to engage with guide rails 24 having the same coordinated profile as in the screed illustrate in FIG. 9, but rather may be configured to engage with differently configured guide rails 24, such as guide rails which may extend forward from linearly from an shotcrete receiving surface 12 having a substantially similarly arcuate profile to the screed 24, or with guide rails which are canted outward from a more linear shotcrete receiving surface 12. Regardless, however, it may be seen that there may exist an essentially infinite variety of screeds with different configurations, each of which is contemplated as falling with the scope and spirit of the present disclosure.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the exemplary embodiments.

What is claimed is:

1. A system for shotcrete construction, the system comprising:

a plurality of guide rails positioned proximal to a shotcrete receiving surface and in substantially parallel alignment to one another, at least one of the guide rails having a spaced region forwardly offset from the shotcrete receiving surface such that the spaced region of the guide rail is placed in front of the shotcrete receiving surface and shotcrete application against the shotcrete receiving surface behind the spaced region is not prevented; and a screed configured to simultaneously traverse along at least a portion of at least two of the guide rails, the screed having a protruding region such that when the screed is traversed along at least said portion of the at least two guide rails following application of shotcrete against the shotcrete receiving surface, the protruding region is operative to rod the shotcrete so as to impart a contour to the shotcrete at least partially defined by the at least two guide rails;

wherein the plurality of guide rails are positioned such that the contour imparted to the shotcrete is substantially dissimilar from that of the shotcrete receiving surface along a direction thereof.

2. The system of claim 1, wherein each of the plurality of guide rails are substantially identical configured such that the contour imparted to the shotcrete is substantially similar along the direction of the shotcrete surface substantially perpendicular to the substantially parallel direction of the guide rails.

3. The system of claim 1, wherein at least two of the plurality of guide rails are substantially differently configured such that the contour imparted to the shotcrete is substantially dissimilar along the direction of the shotcrete surface substantially perpendicular to the substantially parallel direction of the guide rails.

4. The system of claim 1, wherein the screed is configured to traverse along at least one guide rail via manual manipulation.

5. The system of claim 1, wherein the screed is configured to traverse along at least one guide rail via a motor.

6. The system of claim 1, wherein the protruding region of the screed operative to rod the shotcrete is configured to be one or more of: linear, arcuate, curvilinear, serrated, smooth, or combinations thereof.

7. The system of claim 1, wherein at least two guide rails are configured for substantially vertical alignment proximal to a shotcrete receiving surface.

8. The system of claim 7, wherein the screed is configured for substantially horizontal simultaneous traversal along at least two guide rails.

9. The system of claim 1 comprising at least three guide rails, each of the least three guide rails being configured for placement at a regular predefined interval from one or more adjacent guide rails.

10. The system of claim 9, wherein the screed is configured to permit traversal along any adjacent pair of the at least three guide rails.

11. A method for shotcrete construction, the method comprising the steps of:

providing a plurality of guide rails in proximity to a shotcrete receiving surface in substantially parallel alignment to one another and a screed configured to simultaneously traverse along at least a portion of at least two of the guide rails, at least one of the guide rails having a spaced region forwardly offset from the shotcrete receiving surface such that the spaced region of the guide rail is placed in front of the shotcrete receiving surface and shotcrete application against the shotcrete receiving surface behind the spaced region is not prevented, the screed having a protruding region;

applying shotcrete to the shotcrete receiving surface; and simultaneously engaging the screed with and traversing the screed along at least said portion of the at least two guide rails to cause the protruding region to rod the shotcrete and impart a contour thereto at least partially defined by the at least two guide rails such that the contour imparted to the shotcrete is substantially dissimilar from that of the shotcrete receiving surface along a direction thereof.

12. The method of claim 11, wherein each of the plurality of guide rails are substantially identical configured such that the contour imparted to the shotcrete in the engaging step is substantially similar along the direction of the shotcrete surface substantially perpendicular to the substantially parallel direction of the guide rails.

13. The method of claim 11, wherein at least two of the plurality of guide rails are substantially differently configured such that the contour imparted to the shotcrete is substantially dissimilar in the direction of the shotcrete surface substantially perpendicular to the substantially parallel direction of the guide rails.

14. The method of claim 11, wherein the screed is configured to traverse along at least one guide rail via manual manipulation.

15. The method of claim 11, wherein the screed is configured to traverse along at least one guide rail via a motor.

16. The method of claim 11, wherein the protruding region of the screed is configured to be one or more of: linear, arcuate, curvilinear, serrated, smooth, or combinations thereof.

17. The method of claim 11, wherein at least two guide rails are configured for substantially vertical alignment proximal to a shotcrete receiving surface.

18. The method of claim 17, wherein the screed is configured for substantially horizontal simultaneous traversal along at least two guide rails.

19. The method of claim 11 wherein at least three guide rails are provided in the providing step, each of the least three guide rails being configured for placement at a regular predefined interval from one or more adjacent guide rails.

20. The method of claim 19, wherein the screed is configured to permit simultaneous traversal along any adjacent pair of the at least three guide rails.

* * * * *